US012617513B2

(12) United States Patent
Johnson

(10) Patent No.: US 12,617,513 B2
(45) Date of Patent: May 5, 2026

(54) OUTBOARD MARINE ENGINE WITH INTEGRATED PERCEPTION SENSOR

(71) Applicant: Sea Machines Robotics, Inc., Boston, MA (US)

(72) Inventor: Michael Gordon Johnson, Belmont, MA (US)

(73) Assignee: Sea Machines Robotics, Inc., Boston, MA (US)

( * ) Notice: Subject to any disclaimer, the term of this patent is extended or adjusted under 35 U.S.C. 154(b) by 342 days.

(21) Appl. No.: 18/311,032

(22) Filed: May 2, 2023

(65) Prior Publication Data

US 2023/0348034 A1 Nov. 2, 2023

Related U.S. Application Data

(60) Provisional application No. 63/337,418, filed on May 2, 2022.

(51) Int. Cl.

| | |
|---|---|
| ***B63H 20/12*** | (2006.01) |
| ***B63B 79/10*** | (2020.01) |
| ***B63B 79/40*** | (2020.01) |

(52) U.S. Cl.
CPC ..... *B63H 20/12* (2013.01); *B63B 79/10* (2020.01); *B63B 79/40* (2020.01)

(58) Field of Classification Search
CPC ..... B63H 20/12; B63B 79/10; B63B 79/40
See application file for complete search history.

(56) References Cited

U.S. PATENT DOCUMENTS

| | | | | |
|---|---|---|---|---|
| 10,467,908 | B2 | 11/2019 | Johnson | |
| 11,175,663 | B1 | 11/2021 | Johnson et al. | |
| 2020/0140051 | A1* | 5/2020 | Derginer | G05D 1/0875 |
| 2022/0066448 | A1* | 3/2022 | Corbett | B62M 6/65 |

FOREIGN PATENT DOCUMENTS

| | | | | |
|---|---|---|---|---|
| EP | 3923106 | A1 * | 12/2021 | G01S 7/4972 |

* cited by examiner

*Primary Examiner* — Stephen P Avila
(74) *Attorney, Agent, or Firm* — Bass Patent Law, LLC

(57) ABSTRACT

An outboard engine unit for a marine vessel may, in addition to including an engine and a thrust unit, be outfitted with one or more perception sensors configured to capture images of a field of view, where the field of view maintains a fixed spatial relationship with the thrust direction in which the thrust unit is providing thrust for the marine vessel. Further, the outboard engine unit may further include an orientation sensor configured to sense the orientation of the thrust direction relative to the vessel.

20 Claims, 5 Drawing Sheets

OUTBOARD MARINE ENGINE WITH INTEGRATED PERCEPTION SENSOR

CROSS-REFERENCE TO RELATED APPLICATIONS

This application claims priority to U.S. Provisional Pat. App. No. 63/337,418 filed on May 2, 2022, the entire contents of which are hereby incorporated by reference herein.

BACKGROUND

Along with conventional marine vehicles, autonomous, semi-autonomous, and remote-controlled marine vehicles are increasing in popularity. Among other technology, such marine vehicles beneficially employ one or more perception sensors to help visualize their surroundings. Such visualization can assist in certain autonomous navigation tasks, including but not limited to collision avoidance.

An outboard engine unit is a popular system to provide thrust and steering capabilities to a relatively broad class of marine vehicles, including recreational or commercial vehicles about 15 feet to 65 feet in length.

SUMMARY

In an aspect, an outboard engine unit for a marine vessel disclosed herein may include: an engine for providing power to a thrust unit; a thrust unit for providing thrust to the vessel in a thrust direction; a perception sensor configured to capture images of a field of view, in which the field of view maintains a fixed spatial relationship with the thrust direction; and an orientation sensor configured to sense the orientation of the thrust direction relative to the vessel.

Implementations may include one or more of the following features. The engine unit may include a plurality of perception sensors that have a collective field of view including 360 degrees around the marine vessel. The engine unit may include an actuator operable to change the thrust direction or magnitude in response to a control signal. The engine unit may include input/output circuitry operable to transmit the thrust direction and an image captured from the perception sensor to a computing resource. The engine unit may include an actuator operable to change the thrust direction or magnitude in response to a control signal, in which the input/output circuitry may be further operable to receive the control signal from a remote location. The engine unit may include a computing resource, in which the computing resource includes an image processor operable to extract information from the image. The computing resource may be further configured to produce a control signal based in part on the extracted information. The engine unit may include inertial instruments configured to detect a motion of the vessel. The engine unit may include a geolocation unit operable to detect a location of the engine unit in a global coordinate system.

In an aspect, an outboard engine unit for a marine vessel disclosed herein may include: an engine for providing power to a thrust unit; a thrust unit for providing thrust to the vessel in a thrust direction; a till mechanically coupled to thrust unit configured to allow a pilot of the vessel to change the thrust direction, thereby steering the vessel; and a perception sensor unit reception port for providing an electromechanical coupling of one or more perception sensors to the engine unit.

Implementations may include one or more of the following features. The mechanical coupling between one or more perception sensors and the engine unit may maintain a field of view of each perception sensor in a fixed spatial relationship with the thrust direction. The engine unit may include an actuator operable to change the thrust direction or magnitude in response to a control signal. The engine unit may include input/output circuitry operable to transmit the thrust direction and an image captured from the perception sensor to a computing resource. The engine unit may include an actuator operable to change the thrust direction or magnitude in response to a control signal, in which the input/output circuitry may be further operable to receive the control signal from a remote location. The engine unit may include a computing resource, in which the computing resource includes an image processor operable to extract information from the image. The computing resource may be further configured to produce a control signal based in part on the extracted information. The engine unit may include inertial instruments configured to detect a motion of the vessel. The engine unit may include a geolocation unit operable to detect a location of the engine unit in a global coordinate system.

These and other features, aspects, and advantages of the present teachings will become better understood with reference to the following description, examples, and appended claims.

BRIEF DESCRIPTION OF THE DRAWINGS

The foregoing and other objects, features and advantages of the devices, systems, and methods described herein will be apparent from the following description of particular embodiments thereof, as illustrated in the accompanying drawings. The drawings are not necessarily to scale, emphasis instead being placed upon illustrating the principles of the devices, systems, and methods described herein. In the drawings, like reference numerals generally identify corresponding elements.

DETAILED DESCRIPTION

Figure 1:
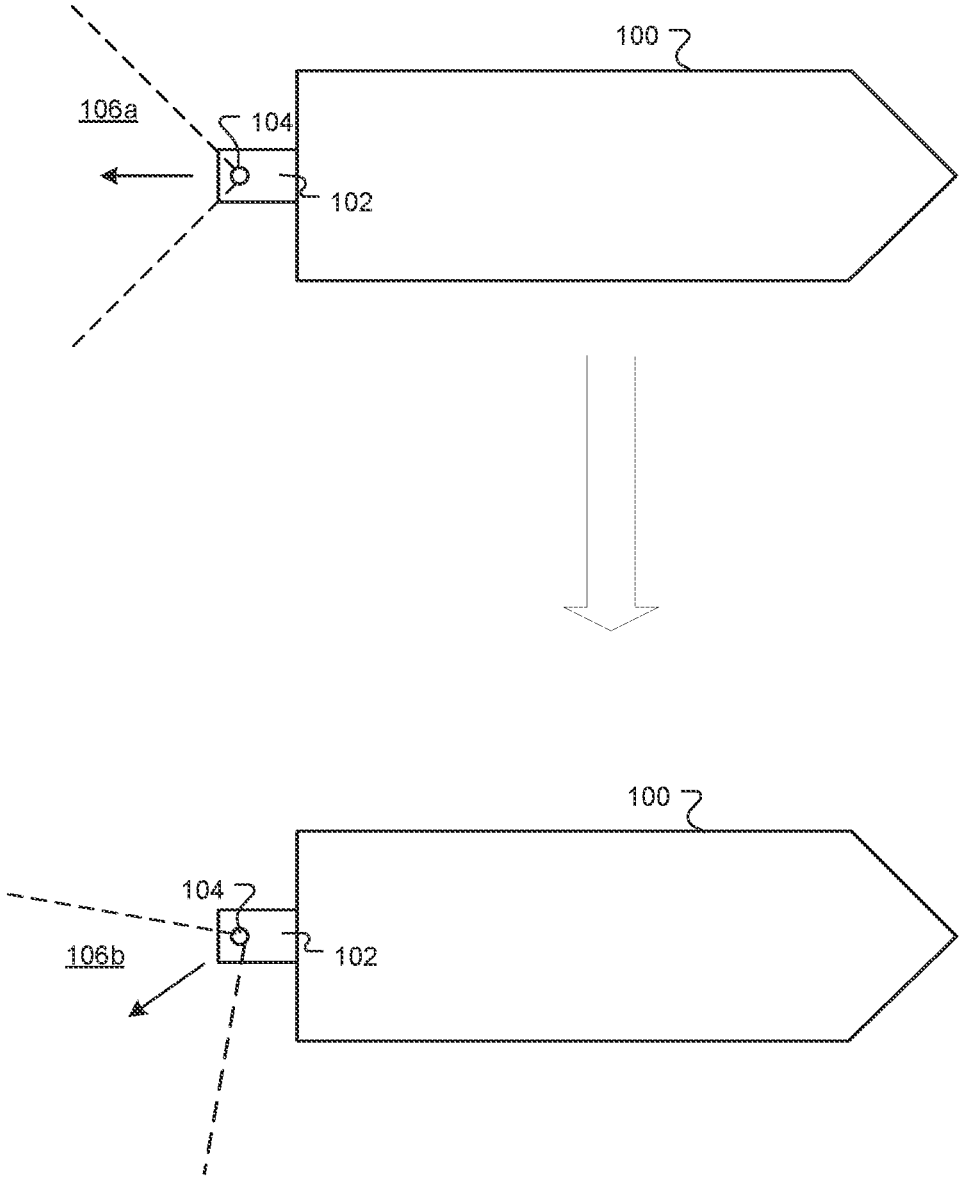
FIG. 1 is an overhead view of a marine vessel.

The embodiments will now be described more fully hereinafter with reference to the accompanying figures, in which preferred embodiments are shown. The foregoing may, however, be embodied in many different forms and should not be construed as limited to the illustrated embodiments set forth herein. Rather, these illustrated embodiments are provided so that this disclosure will convey the scope to those skilled in the art.

All documents mentioned herein are hereby incorporated by reference in their entirety. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values herein are not intended to be limiting, referring instead individually to any and all values falling within the range, unless otherwise indicated herein, and each separate value within such a range is incorporated into the specification as if it were individually recited herein. The words "about," "approximately" or the like, when accompanying a numerical value, are to be construed as indicating a deviation as would be appreciated by one of ordinary skill in the art to operate satisfactorily for an intended purpose. Similarly, words of approximation such as "about," "approximately," or "substantially" when used in reference to physical characteristics, should be understood to contemplate a range of deviations that would be appreciated by one of ordinary skill in the art to operate satisfactorily for a corresponding use, function, purpose, or the like. Ranges of values and/or numeric values are provided herein as examples only, and do not constitute a limitation on the scope of the described embodiments. Where ranges of values are provided, they are also intended to include each value within the range as if set forth individually, unless expressly stated to the contrary. The use of any and all examples, or exemplary language ("e.g.," "such as," or the like) provided herein, is intended merely to better illuminate the embodiments and does not pose a limitation on the scope of the embodiments. No language in the specification should be construed as indicating any unclaimed element as essential to the practice of the embodiments.

In the following description, it is understood that terms such as "first," "second," "top," "bottom," "up," "down," and the like, are words of convenience and are not to be construed as limiting terms unless specifically stated to the contrary.

Some marine vessels, for example those between 15' and 65' in length, are often equipped with an outboard engine unit. Among other advantages, outboard engine units are often removable from a marine vessel, making repair or replacement convenient. Moreover, the modular nature of outboard engine units provides a great deal of compatibility between outboard engine units and vessels, whereby boating enthusiasts can "mix and match" engines with vessels with a relatively high degree of flexibility. For these and other reasons, such engine units are therefore favored by recreational boating enthusiasts and commercial and/or governmental boat operators.

There is an increasing demand for marine vessels that are autonomous, semi-autonomous, or capable of being piloted by remote control. One potentially important component to enable such functionality is one or more perception sensors (including but not limited to cameras) on board the vessel.

Although in principle perception sensors can be mounted anywhere on a vessel, mounting a perception sensor on a vessel's hull can sometimes be disadvantageous for a number of reasons. For example, without customization, many small vessels lack the electrical circuitry to power perception sensors or process their images. Thus, mounting one or more perception sensors on an outboard engine unit can be advantageous. However, mounting a perception sensor on an outboard engine unit involves challenges.

FIG. 1 is an overhead view of a marine vessel. In an initial configuration illustrated in the top portion of FIG. 1, the vessel 100 includes an outboard engine unit 102 that is providing thrust in the direction indicated by the arrow. The outboard engine unit 102 includes a perception sensor 104 that has an initial field of view 106*a*. Although only one engine unit 102 is shown in FIG. 1, in general a marine vessel may use several such engine units.

Steering a vessel having an outboard engine unit typically involves rotating all or substantially all of the engine unit, thereby changing the direction of the thrust it provides. This is illustrated in a second configuration of the vessel 100, illustrated in the bottom portion of FIG. 1. Consequently, the perception sensor's field of view 106*b* in this configuration has changed along with the direction of thrust. Although not illustrated in FIG. 1, in some circumstances the orientation of the thrust changes in a vertical direction as well, thereby affecting the pitch of the vessel 100 and similarly affecting the perception sensor's field of view.

These changes can complicate the use of the perception sensor for visualization of the marine vessel's environment. Many traditional uses of perception sensors in the context of navigation require knowing the position of a perception sensor's field of view with respect to the vessel in order to successfully process its image. Thus, any changes to the field of view of such a perception sensor need be accounted for, in order for the information obtained by the sensor to be useful.

For example, an obstruction such as a large rock detected in an image poses a safety threat to the vessel if the image is showing the vessel's current direction of travel. In turn, this may trigger an autonomous maneuver intended to avoid colliding with the rock. However, if the rock appears in an image off the side of the vessel, it does not pose a safety threat and would not trigger a maneuver.

The techniques and systems described below, among other things, address this challenge.

Figure 2:
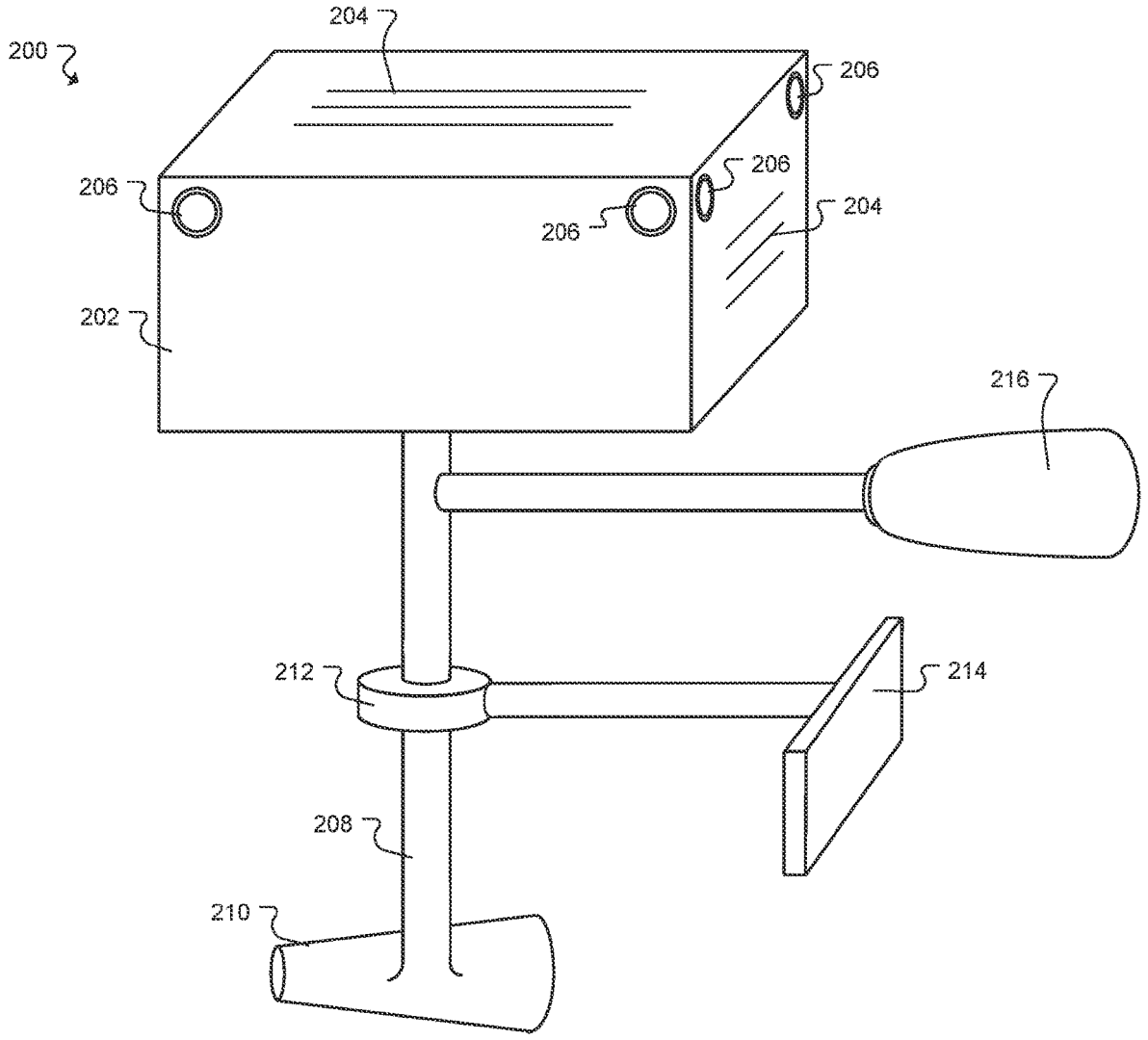
FIG. 2 is a perspective view of an engine unit.

FIG. 2 is a perspective view of an outboard engine unit. The engine unit 200 includes an engine housing 202, vents 204, perception sensors 206, a shaft housing 208, and a thrust unit 210. For the sake of simplicity, traditional components of an outboard engine unit are not shown. For example, the engine housing 202 encloses an engine (not shown). The engine could be an internal combustion engine or an electric motor of any type suitable for the space and power requirements of the engine unit 200. The engine housing 202 also includes a source of electrical power, such as a battery and/or an alternator, for powering the perception sensors 206 and other circuitry described more fully below.

The engine typically drives a shaft (not shown) contained in the shaft housing 208. The shaft provides mechanical power to the thrust unit 210, which consequently powers the vessel.

Figure 3:
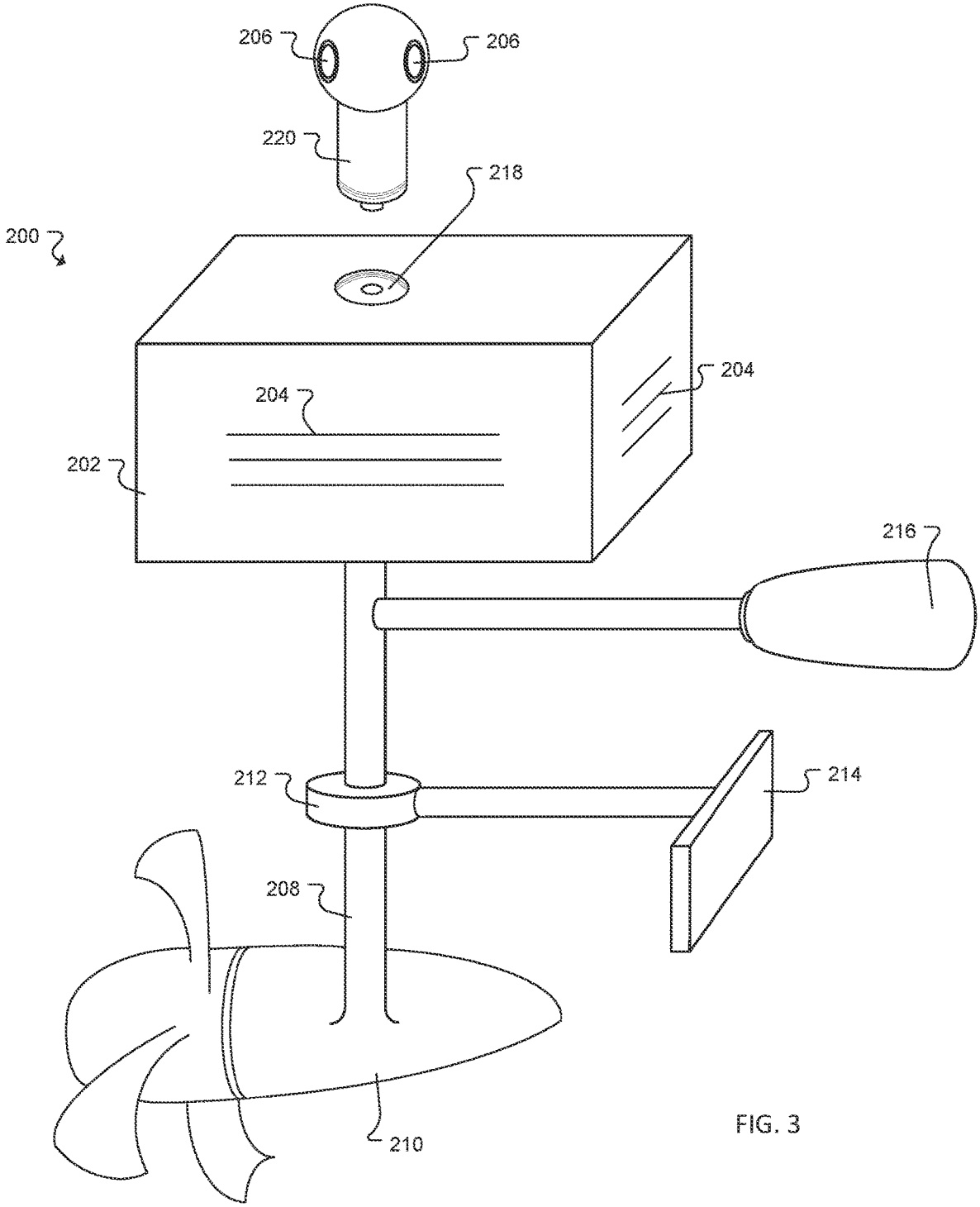
FIG. 3 is a partially exploded view of an engine unit.

In some implementations, the thrust unit 210 can employ a jet assembly (as shown in FIG. 2), a propeller assembly (as shown in FIG. 3), or any other suitable thrust-generation equipment. For clarity, traditional components of the jet assembly (e.g., impeller pump, deflectors, etc.) are not shown. Similarly, traditional components of the propeller assembly (various shafts, a gear box, etc.) are not shown. Finally, in practice, the engine unit 200 would typically include various fins, rudders, or other surfaces to assist in the steering or stabilization of the vessel. These components are also not shown to aid clarity of the present teachings.

The shaft housing 208 (or in some implementations, the shaft contained therein) passes through a collar 212. The collar 212 can include an orientation sensor operable to detect and output a signal encoding the rotational orientation of the shaft housing 208 relative to the collar 212.

The engine unit 200 includes a mount 214 for mounting the unit 200 to the transom of a marine vessel. Although shown as a mounting plate in FIG. 2, in general the mount 214 may involve any suitable mechanical coupling, including but not limited to one or more clamps, brackets, threaded connectors such as bolts, screws, etc.

In some implementations, the engine unit 200 includes a till 216 and the components of the engine unit 200 are fixed relative to each other. Thus, a pilot can use the till 216 to rotate or tilt the engine unit 200 within the collar 212, thereby steering the vessel. On the other hand, in some implementations, the engine unit 200 includes one or more actuators such as hydraulic rams or electric drives (not shown) that are operable to rotate or tilt the engine unit 200 under direction of one or more control signals.

Although four perception sensors 206 are shown in FIG. 2, in general any number of perception sensors may be used. In some implementations, a single aft-facing sensor having a 90 degree field of view is used. In some implementations, there are sufficiently many perception sensors such that their collective field of view encompasses 180 degrees or 360 degrees around the engine unit 200. Any type of perception sensor may be used, including but not limited to visible light and/or infrared cameras, LIDAR sensors, radar sensors, sonar sensors, etc. In some implementations, the perception sensor 206 includes an AXIS Q1798-LE camera.

FIG. 3 is a partially exploded view of an engine unit 200, showing an alternative embodiment. In FIG. 3, instead of perception sensors 206 integrated into the engine housing 202 as shown in FIG. 2 for example, the engine housing 202 includes a perception sensor unit connection 218. The connection 218 provides mechanical, electrical, and/or data connections to a perception sensor unit 220 having one or more perception sensors 206. In some implementations, the connection 218 is positioned in the engine housing 202 such that the perception sensor unit 220, when connected to the housing, is collinear with the shaft housing 208. In this configuration, steering the vessel results in the perception sensors 206 undergoing purely rotational motion, rather than a combination of rotational and translational motion. Consequently, this reduces the computational resources required to process images obtained by the perception sensors as described more fully below.

Figure 4:
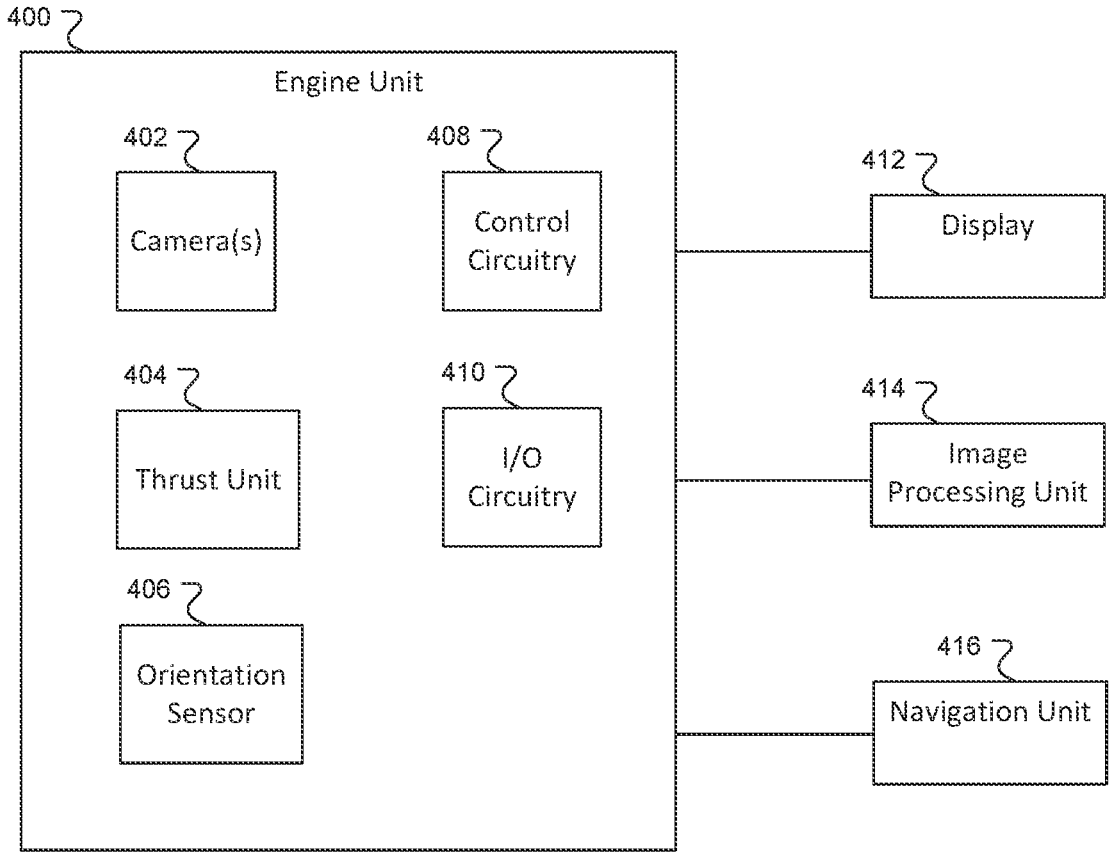
FIG. 4 is a block diagram of an engine unit.

FIG. 4 is a block diagram of an outboard engine unit. The engine unit 400 includes one or more perception sensors 402, a thrust unit 404, an orientation sensor 406, control circuitry 408, input/output (or "I/O") circuitry 410, and one or more actuators 412.

The perception sensors 402 are operable to capture real-time representations of their respective fields of view. For convenience, these representations are referred to as "images" in what follows, although use of the word "image" should not be construed to mean the perception sensors are limited to cameras.

The perception sensors are in data communication with the I/O circuitry 410, such that the output of the perception sensors can be sent to a remote computational resource, such as an external image processor 414 in data communication with the engine unit 400 via the I/O circuitry 410. In some implementations, the perception sensors 402 are positioned within the engine unit 400 such that each perception sensor's field of view maintains a fixed spatial relationship relative to the direction of thrust provided by the thrust unit 404, even when this direction is changing (e.g., during steering maneuvers).

The thrust unit 404 is operable to generate thrust, thereby propelling the engine unit 400 (and therefore, the vessel to which the unit is mounted) through the water. In some implementations, the thrust unit 404 has mechanical controls, such as a manual throttle for controlling the magnitude of thrust, or a till to control the direction of thrust. In some implementations, the thrust unit 404 includes one or more actuators capable of receiving electrical control signals and changing the thrust magnitude and/or direction according to such received signals. In some implementations, the thrust unit 404 includes a jet engine. In some implementations, the thrust unit 404 includes a propeller.

The orientation sensor 406 is operable to sense a direction of thrust provided by the thrust unit 404, and to output a signal describing such orientation in real time. The orientation sensor 406 may include any sensor capable of sensing position or changes in position, such as optical sensors, mechanical sensors, magnetic sensors, piezoelectric sensors or strain gauges, etc. In some implementations, a SEASTAR SMARTSTICK may be used (e.g., among other sensors). Although an example orientation sensor configuration is described above as sensing the rotation of a shaft or shaft housing, in general the orientation sensor may be configured to sense the orientation of any component of the engine unit 400 that is correlated to the thrust direction by any rigid coupling.

The control circuitry 408 is operable to supply a control signal to the actuators of the thrust unit 404, thereby controlling the direction and magnitude of thrust produced. In some implementations, the control circuitry 408 includes wired electronic connections to control hardware such as joysticks, steering wheels, throttles, etc. In some implementations, the control circuitry is in data communication with the I/O circuitry 410, thereby allowing the control circuitry 408 to determine control signals based on external input.

The I/O circuitry 410 is operable to send data to, and receive data from, resources remote from the engine unit 400. The I/O circuitry 410 can include one or more antennae and associated circuitry to communicate via any known wireless data transmission protocol, including but not limited to WiFi; 3G, 4G, or 5G; Bluetooth; etc. The I/O circuitry 410 may also include one or more Universal Serial Bus connections, or any other communication busses operable to implement a wired connection between the engine unit 400 and remote input hardware.

In some implementations, the engine unit 400 is in data communication with a remote display 412. Such display can be included, for example, on a mobile phone, tablet, or other computing device. In some implementations, this hardware can be used to show a remote viewer real-time images of the vessel's surroundings, thereby facilitating remote control of the vessel via the mobile phone, tablet, or other computing device.

Figure 5:
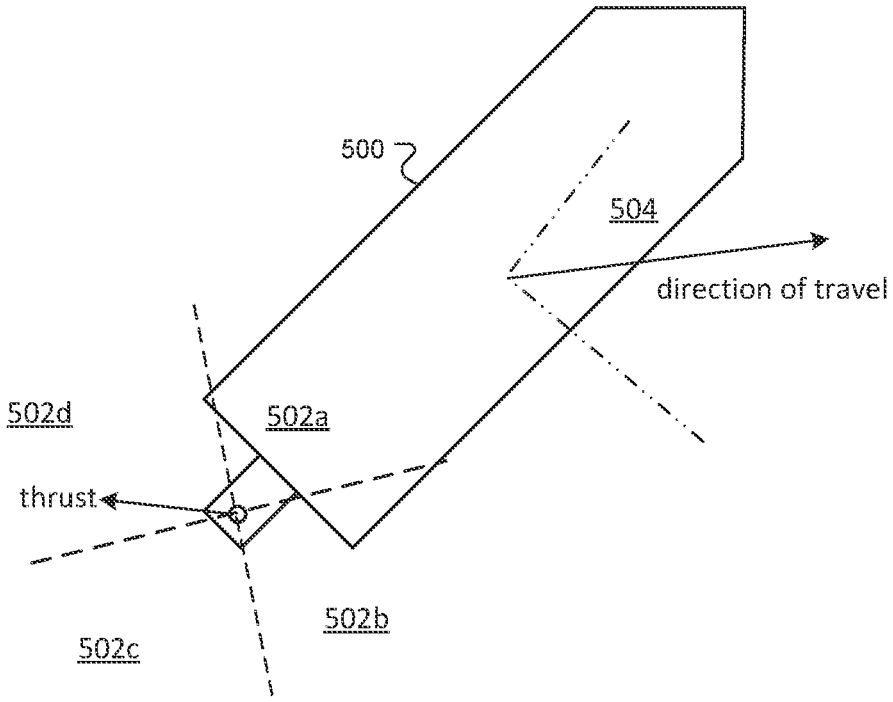
FIG. 5 is an overhead view of a marine vessel in a turning maneuver.

FIG. 5 shows an overhead view of a marine vessel in a turning maneuver. The vessel 500 has an outboard engine unit as described above, providing thrust in the direction indicated as in FIG. 5, with a direction of travel indicated in FIG. 5. In some implementations, the direction of travel may be determined by an on-board inertial measurement unit ("IMU") comprising one or more accelerometers, gyroscopes, or other inertial instruments. In some implementations, the IMU is included in the engine unit. In some implementations, the direction of travel may be determined by reference to a time series of coordinates output from a geolocation unit, operable to determine its location in some global coordinate system. The geolocation unit can include a Global Positioning Satellite (GPS) receiver, a GLONASS receiver, a BeiDou receiver, a Galileo receiver, or some other receiver configured to receive and decode signals of a global navigation satellite system (GNSS). In some implementations, the geolocation unit is included in the engine unit.

In the example of FIG. 5, the engine unit also includes four perception sensors having 90 degree fields of view (respectively 502*a*, 502*b*, 502*c*, and 502*d*). The fields of view collectively image a 360 degree field of view of the vessel. In some implementations, the remote pilot is presented on the remote display 412 with a hybrid view 504 that is created by stitching images (or portions thereof) from two or more of the available fields of view 502*a-d*. In some implementations, the hybrid view 504 is centered on the direction of travel. In some implementations, the hybrid view 504 has a field of view between 45 degrees and 90 degrees. In some implementations, the hybrid view 504 is centered on a user-selected orientation or direction. In some implementations, the views 502*a-d* may be synthesized into a bird's eye view.

Advantageously, presenting a remote pilot with one or more of these hybrid views 504 may allow the pilot to better navigate than if they were presented with a static view from one of the perception sensors 502*a-d*. In particular, when the vessel 500 is engaged in a turning maneuver, the direction of travel of the vessel may not coincide with the center of any particular sensor field of view. However, from a human factors perspective, piloting the vessel from a view centered on its direction of motion may be more natural to some pilots than piloting the vessel from another view.

Referring back to FIG. 4, in some implementations, the engine unit 400 is in data communication with an image processing unit 412. The imagine processing unit 412 can include hardware, software, or a combination of hardware and software that is collectively operable to process images from the perception sensor and extract information relevant to navigation. Such image processing functionality is well known in the art. For example the image processing unit 412 can identify potential risks of collisions, and alert the pilot and/or autonomously perform an avoidance maneuver.

The navigation unit 416 is operable to produce control signals remote from the engine unit 400. In some implementations, the navigation unit includes traditional navigation hardware such as joysticks, steering wheels, throttles, etc. that are in electronic communication with the engine unit 400. Such "steer by wire" hardware (and supporting software) is well known in the art. In some implementations, the navigation unit 416 is operable to produce control signals responsive to input from a remote controller. Such a remote controller may include a smartphone, laptop, tablet, etc. In some implementations, the navigation unit 416 includes autonomous navigation hardware, such as is described in U.S. Pat. No. 10,467,908, entitled "Autonomous Boat Design for Tandem Towing," the entirety of which is incorporated by reference herein.

The techniques and devices described above may have particular applicability.

In some implementations, an aft-facing camera of the engine unit 400 can identify approaching or over-taking traffic. That is, the image processing unit 414 may be configured using traditional techniques to identify objects in the field of view and the range to those objects. When objects cross a distance threshold, a warning is delivered to a pilot of the vessel or other person via the display 412 or some other way, including but not limited to an auditory alarm played through the loudspeaker of a mobile device or computer. In some implementations, the threshold may be static (e.g. a threshold in the range of 10-500 feet). In some implementations, the threshold may be dynamic, such as a threshold based on an expected time for the object to overtake the vessel based on the object's speed and the vessel's speed.

In some implementations, the aft-facing camera can continuously monitor the relative position of a towed person (e.g., a water-skier) or object and report this position on the display 412. In some implementations, a warning may be activated when the distance to the person or object increases above a pre-determined threshold or the position increases by a rate greater than the pre-defined threshold.

In some implementations, the aft-facing camera can be used to monitor safety conditions. While the engine unit 400 is providing thrust, objects within a relatively close distance to the unit may pose a safety risk to the engine unit, the passengers of the vessel, and the objects themselves. Thus, in some implementations, the image processing unit 414 may be configured to identify objects within a relatively close distance (e.g., 5-20 feet) and sound an alarm when an object appears in that distance while the engine unit 400 is providing thrust. In some implementations, the navigation unit 416 is configured to automatically provide a signal to shut down the engine when an object appears within a relatively close distance (e.g., 5-20 feet). In some implementations, the engine unit 400 may not be activated when an object is detected within a relatively close distance (e.g., 5-20 feet).

In some implementations, the image processing unit 414 may be configured to identify navigational aids, such as buoys, signs, lane lines, or other aids. These navigational aids may be subsequently highlighted in as an augmented-reality layer in addition to the live view from the perception sensor.

In some implementations, the image processing unit 414 may be configured to correct for jitter or other artifacts introduced to the camera output by vibration of the engine unit 400 during operation. Any known techniques for correcting such artifacts may be employed, such as digital image stabilization techniques and/or filters. In some implementations, image stabilization techniques are performed using only the images obtained from camera(s) 402. In some implementations, image stabilization techniques are performed using these images, together with the output signal from the orientation sensor 406.

In some implementations, the engine unit 400 may be used to share video content. In some implementations, the video content may be recreational in nature, such as fishing or watersports content. In some implementations, the video content may be practical in nature, such as surveillance video or safety monitoring video content. Shared video content may be sent via the I/O circuitry to a remote server where it is saved and subsequently displayed to other users who may not necessarily be remote pilots of the vessel. In some implementations, the engine unit 400 includes an integrated data storage medium to locally record video content in addition to sharing it. In some implementations, the I/O circuitry 410 includes a universal serial bus (USB) or other data connection, configured to allow a user to provide an external data storage medium for recording video content.

It will be understood that aspects of the present teachings as described herein may include one or more of the features described in U.S. Pat. No. 11,175,663, entitled "Automated Marine Navigation," the entirety of which is incorporated by reference herein; and/or it will be understood that aspects of the present teachings as described herein may include one or more of the features described in U.S. Pat. No. 11,423,667, entitled "Geolocating an Object using a Single Camera," the entirety of which is incorporated by reference herein.

The methods, components, modules, or other approaches described above may be implemented in software, or in hardware, or a combination of hardware and software. The software may include instructions stored on a non-transitory machine-readable medium, and when executed on a general-purpose or a special-purpose processor implements some or all of the steps summarized above. The hardware may include Application-Specific Integrated Circuits (ASICs), Field Programmable Gate Arrays (FPGAs), and the like. The hardware may be represented in a design structure. For example, the design structure comprises a computer accessible non-transitory storage medium that includes a database representative of some or all of the components of a system embodying the steps summarized above. Generally, the database representative of the system may be a database or other data structure which can be read by a program and used, directly or indirectly, to fabricate the hardware comprising the system. For example, the database may be a behavioral-level description or register-transfer level (RTL) description of the hardware functionality in a high-level design language (HDL) such as Verilog or VHDL. The description may be read by a synthesis tool which may synthesize the description to produce a netlist comprising a list of gates from a synthesis library. The netlist comprises a set of gates which also represent the functionality of the hardware comprising the system. The netlist may then be placed and routed to produce a data set describing geometric shapes to be applied to masks. The masks may then be used in various semiconductor fabrication steps to produce a semiconductor circuit or circuits corresponding to the system. In other examples, alternatively, the database may itself be the netlist (with or without the synthesis library) or the data set.

The above systems, devices, methods, processes, and the like may be realized in hardware, software, or any combination of these suitable for a particular application. The hardware may include a general-purpose computer and/or dedicated computing device. This includes realization in one or more microprocessors, microcontrollers, embedded microcontrollers, programmable digital signal processors or other programmable devices or processing circuitry, along with internal and/or external memory. This may also, or instead, include one or more application-specific integrated circuits, programmable gate arrays, programmable array logic components, or any other device or devices that may be configured to process electronic signals. It will further be appreciated that a realization of the processes or devices described above may include computer-executable code created using a structured programming language such as C, an object-oriented programming language such as C++, or any other high-level or low-level programming language (including assembly languages, hardware description languages, and database programming languages and technologies) that may be stored, compiled or interpreted to run on one of the above devices, as well as heterogeneous combinations of processors, processor architectures, or combinations of different hardware and software. In another aspect, the methods may be embodied in systems that perform the steps thereof, and may be distributed across devices in a number of ways. At the same time, processing may be distributed across devices such as the various systems described above, or all of the functionalities may be integrated into a dedicated, standalone device or other hardware. In another aspect, means for performing the steps associated with the processes described above may include any of the hardware and/or software described above. All such permutations and combinations are intended to fall within the scope of the present disclosure.

Embodiments disclosed herein may include computer program products comprising computer-executable code or computer-usable code that, when executing on one or more computing devices, performs any and/or all of the steps thereof. The code may be stored in a non-transitory fashion in a computer memory, which may be a memory from which the program executes (such as random-access memory associated with a processor), or a storage device such as a disk drive, flash memory, or any other optical, electromagnetic, magnetic, infrared, or other device or combination of devices. In another aspect, any of the systems and methods described above may be embodied in any suitable transmission or propagation medium carrying computer-executable code and/or any inputs or outputs from the same.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings.

Unless the context clearly requires otherwise, throughout the description, the words "comprise," "comprising," "include," "including," and the like are to be construed in an inclusive sense as opposed to an exclusive or exhaustive sense; that is to say, in a sense of "including, but not limited to." Additionally, the words "herein," "hereunder," "above," "below," and words of similar import refer to this application as a whole and not to any particular portions of this application.

It will be appreciated that the devices, systems, and methods described above are set forth by way of example and not of limitation. For example, regarding the methods provided above, absent an explicit indication to the contrary, the disclosed steps may be modified, supplemented, omitted, and/or re-ordered without departing from the scope of this disclosure. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context.

The method steps of the implementations described herein are intended to include any suitable method of causing such method steps to be performed, consistent with the patentability of the following claims, unless a different meaning is expressly provided or otherwise clear from the context. So, for example, performing the step of X includes any suitable method for causing another party such as a remote user, a remote processing resource (e.g., a server or cloud computing) or a machine to perform the step of X. Similarly, performing steps X, Y, and Z may include any method of directing or controlling any combination of such other individuals or resources to perform steps X, Y, and Z to obtain the benefit of such steps. Thus, method steps of the implementations described herein are intended to include any suitable method of causing one or more other parties or entities to perform the steps, consistent with the patentability of the following claims, unless a different meaning is expressly provided or otherwise clear from the context. Such parties or entities need not be under the direction or control of any other party or entity, and need not be located within a particular jurisdiction.

It will be appreciated that, while particular embodiments have been shown and described, it will be apparent to those skilled in the art that various changes and modifications in form and details may be made therein without departing from the spirit and scope of this disclosure and are intended to form a part of the invention as defined by the following claims, which are to be interpreted in the broadest sense allowable by law.

What is claimed is:

1. An outboard engine unit for a marine vessel comprising:

an engine for providing power to a thrust unit;

a thrust unit for providing thrust to the vessel in a thrust direction;

a perception sensor configured to capture images of a field of view, in which the field of view maintains a fixed spatial relationship with the thrust direction;

an orientation sensor configured to sense the orientation of the thrust direction relative to the vessel;

input/output circuitry operable to transmit the thrust direction and an image captured from the perception sensor to a computing resource; and an actuator operable to change the thrust direction or magnitude in response to a control signal, in which the input/output circuitry is further operable to receive the control signal from a remote location.

2. The engine unit of claim 1, further comprising a plurality of perception sensors that have a collective field of view comprising 360 degrees around the marine vessel.

3. The engine unit of claim 1, further comprising an actuator operable to change the thrust direction or magnitude in response to a control signal.

4. The engine unit of claim 1, further comprising the computing resource, in which the computing resource includes an image processor operable to extract information from the image.

5. The engine unit of claim 4, in which the computing resource is further configured to produce a control signal based in part on the extracted information.

6. The engine unit of claim 1, further comprising inertial instruments configured to detect a motion of the vessel.

7. The engine unit of claim 1, further comprising a geolocation unit operable to detect a location of the engine unit in a global coordinate system.

8. An outboard engine unit for a marine vessel comprising:

an engine for providing power to a thrust unit;

a thrust unit for providing thrust to the vessel in a thrust direction;

a till mechanically coupled to thrust unit configured to allow a pilot of the vessel to change the thrust direction, thereby steering the vessel; and a perception sensor unit reception port for providing an electromechanical coupling of one or more perception sensors to the engine unit, the electromechanical coupling between the one or more perception sensors and the engine unit maintaining a field of view of each perception sensor in a fixed spatial relationship with the thrust direction.

9. The engine unit of claim 8, further comprising an actuator operable to change the thrust direction or magnitude in response to a control signal.

10. The engine unit of claim 8, further comprising input/output circuitry operable to transmit the thrust direction and an image captured from the perception sensor to a computing resource.

11. The engine unit of claim 10, further comprising an actuator operable to change the thrust direction or magnitude in response to a control signal, in which the input/output circuitry is further operable to receive the control signal from a remote location.

12. The engine unit of claim 10, further comprising the computing resource, in which the computing resource includes an image processor operable to extract information from the image.

13. The engine unit of claim 12, in which the computing resource is further configured to produce a control signal based in part on the extracted information.

14. The engine unit of claim 8, further comprising inertial instruments configured to detect a motion of the vessel.

15. The engine unit of claim 8, further comprising a geolocation unit operable to detect a location of the engine unit in a global coordinate system.

16. An outboard engine unit for a marine vessel comprising:

an engine for providing power to a thrust unit;

a thrust unit for providing thrust to the vessel in a thrust direction;

a till mechanically coupled to thrust unit configured to allow a pilot of the vessel to change the thrust direction, thereby steering the vessel;

a perception sensor unit reception port for providing an electromechanical coupling of one or more perception sensors to the engine unit;

input/output circuitry operable to transmit the thrust direction and an image captured from the perception sensor to a computing resource; and an actuator operable to change the thrust direction or magnitude in response to a control signal, in which the input/output circuitry is further operable to receive the control signal from a remote location.

17. The engine unit of claim 16, in which the electromechanical coupling between the one or more perception sensors and the engine unit maintains a field of view of each perception sensor in a fixed spatial relationship with the thrust direction.

18. The engine unit of claim 16, further comprising the computing resource, in which the computing resource includes an image processor operable to extract information from the image.

19. The engine unit of claim 18, in which the computing resource is further configured to produce a control signal based in part on the extracted information.

20. The engine unit of claim 16, further comprising inertial instruments configured to detect a motion of the vessel.

* * * * *